US005397009A

United States Patent [19]

Salmon et al.

[11] Patent Number: 5,397,009

[45] Date of Patent: Mar. 14, 1995

[54] BREAK-AWAY SAFETY CAP FOR CONTAINERS

[75] Inventors: Pierre Salmon, Chatillon D'Azergues; Robert Ramon, Gleize; Jean-Patrice Racine, St Andre De Corcy, all of France

[73] Assignee: Novembal, Anse, France

[21] Appl. No.: 133,793

[22] Filed: Oct. 8, 1993

Related U.S. Application Data

[63] Continuation of Ser. No. 10,757, Jan. 29, 1993, abandoned.

[30] Foreign Application Priority Data

May 29, 1992 [ES] Spain ..... 9201736

[51] Int. Cl.[6] ..... B65D 41/34

[52] U.S. Cl. ..... 215/252; 215/258

[58] Field of Search ..... 215/252, 258

[56] References Cited

U.S. PATENT DOCUMENTS

| | | | |
|---|---|---|---|
| 4,458,821 | 7/1984 | Ostrowsky | 215/252 |
| 4,565,295 | 1/1986 | Mori et al. | 215/252 |
| 4,732,289 | 3/1988 | Granat et al. | 215/252 |
| 4,796,770 | 1/1989 | Begley | 215/252 |
| 4,801,031 | 1/1989 | Barriae | 215/252 |
| 4,805,792 | 2/1989 | Lecinski, Jr. | 215/253 |
| 4,807,771 | 2/1989 | Roy et al. | 215/252 |
| 5,076,453 | 12/1991 | Odet | 215/252 |
| 5,080,246 | 1/1992 | Hayes | 215/252 |

FOREIGN PATENT DOCUMENTS 1213931 4/1960 France .

*Primary Examiner*—Allan N. Shoap
*Assistant Examiner*—Stephen Cronin
*Attorney, Agent, or Firm*—Dowell & Dowell

[57] ABSTRACT

A screw-type closure device comprising a safety cap having a guarantee strip which includes a first ring connected to the bottom of a cap skirt by connecting bridges and a second ring assembled on the first ring by a peripheral zone of reduced thickness which allows the second ring to turn up inside the first ring. The second ring may be divided into at least two independent segments which are separated by gaps. The first ring of the guarantee strip includes at least one oblique groove of reduced thickness opposite one of the gaps in the second ring and which is torn to severe the guarantee strip from the container when the cap is removed.

10 Claims, 3 Drawing Sheets

BREAK-AWAY SAFETY CAP FOR CONTAINERS

This application is a continuation of application Ser. No. 08,010,757, filed Jan. 29, 1993, now abandoned.

BACKGROUND OF THE INVENTION

1. Field of the Invention

The present invention relates to improvements in or relating to screw-cap devices and more particularly to those comprising a safety member for preventing fraudulent access to the contents of a container closed by the device.

2. History of the Related Art

Such safety cap devices are known, comprising a body having a bottom skirt which is associated with an annular element having a bead which engages in a retaining groove in the container, so that unscrewing of the stopper provokes a rupture of this annular element or guarantee strip. The strip is connected to the cap by bridges between which there are free spaces to form a tear-off zone. Demolding of such stoppers is delicate due to the presence of the bead on the inner face of the guarantee strip.

It is an object of the improvements forming the subject matter of the present invention to overcome this drawback and to produce a device of the type in question which responds better than heretofore to the various desiderata of the art and in particular which is easy to demold and of very low cost.

SUMMARY OF THE INVENTION

In accordance with the invention, the annular element constituting the guarantee strip is composed of two successive rings, of which the first is connected to the skirt of the cap proper, the second being assembled on the first by a zone of lesser thickness so that this second ring can be folded inside the closure device before the device is screwed on the neck of the container. Under these conditions, the free end of the second ring abuts, once the device is screwed on the neck, against the lower face of the conventional ring of the neck to lock the closure with respect to the neck.

To prevent rupture or buckling of the connecting bridges when the cap is placed in position on the neck, either the first ring or the end of the skirt is provided with stops which avoid too great a displacement of the guarantee strip in the direction of the cap.

According to another embodiment, the second ring is composed of two sections so as to facilitate the turn-up thereof.

In either case, an O-ring associated with the inner face of the bottom of the cap is either a tubular element or a double-lip seal.

Finally, the second ring, divided into sections or not, may be provided with oblique grooves reducing the thickness of the ring so that the guarantee strip constituted by the two rings is cut into at least two parts and is separated from the neck of the container after the first use.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
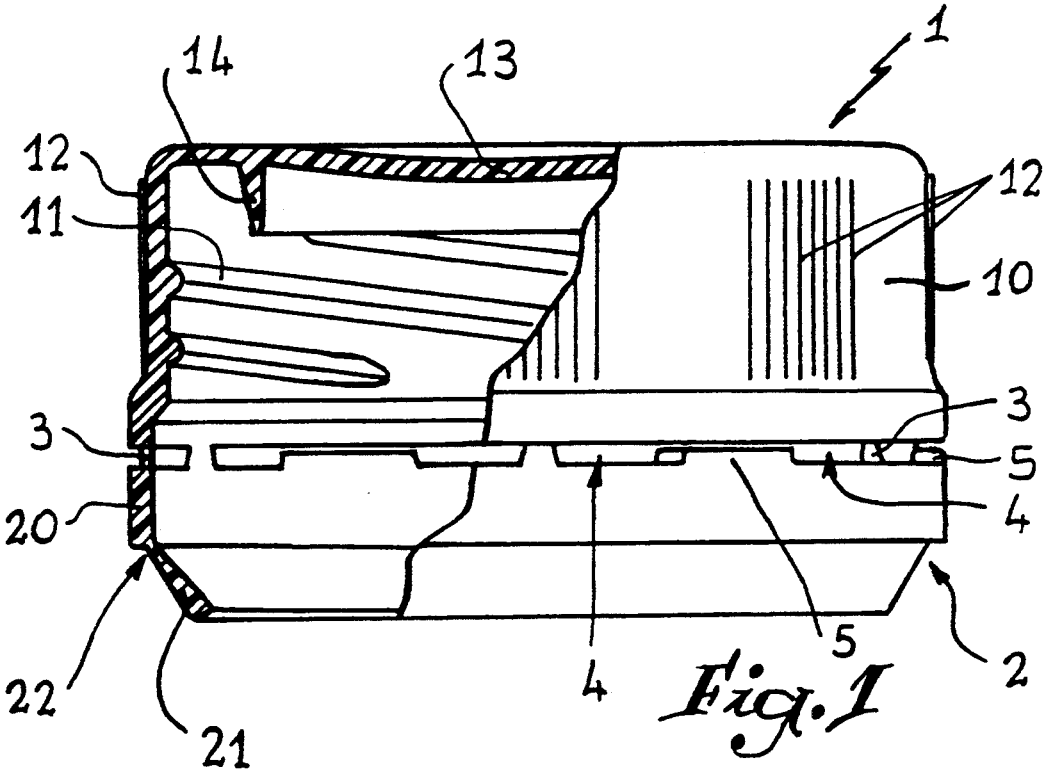
FIG. 1 is a transverse section through a closure device according to the invention, with parts broken away and illustrated as when leaving the injection mold.

Referring now to the drawings, FIG. 1 shows a closure device according to the invention, made of an appropriate plastic material such as polyethylene, essentially comprising a conventional cap generally referenced 1, of which the bottom of the lateral skirt 10 is associated with an annular element or guarantee strip 2.

The skirt 10 is provided on its inner face with threads 11 adapted to cooperate with the thread of the neck of a container (not shown). The periphery of the skirt is provided with longitudinal ribs 12 adapted to facilitate manipulation of the cap. The cap comprises a bottom 13 of which the interior is provided with a conventional tubular seal 14.

The guarantee strip 2 is composed of two rings 20, 21. Ring 20 is connected to the base of the skirt 10 by means of conventional bridges 3 which define therebetween spaces 4 separating ring 20 from the skirt 10. The first ring 20 is assembled on the second 21 by a zone of lesser thickness 22, the second ring having the form of an upwardly open cone, while its transverse section is triangular.

Stops 5 and 5' integral, either with the top of the ring 20, or with the bottom of the skirt 10, are arranged in spaces 4.

Figure 2:
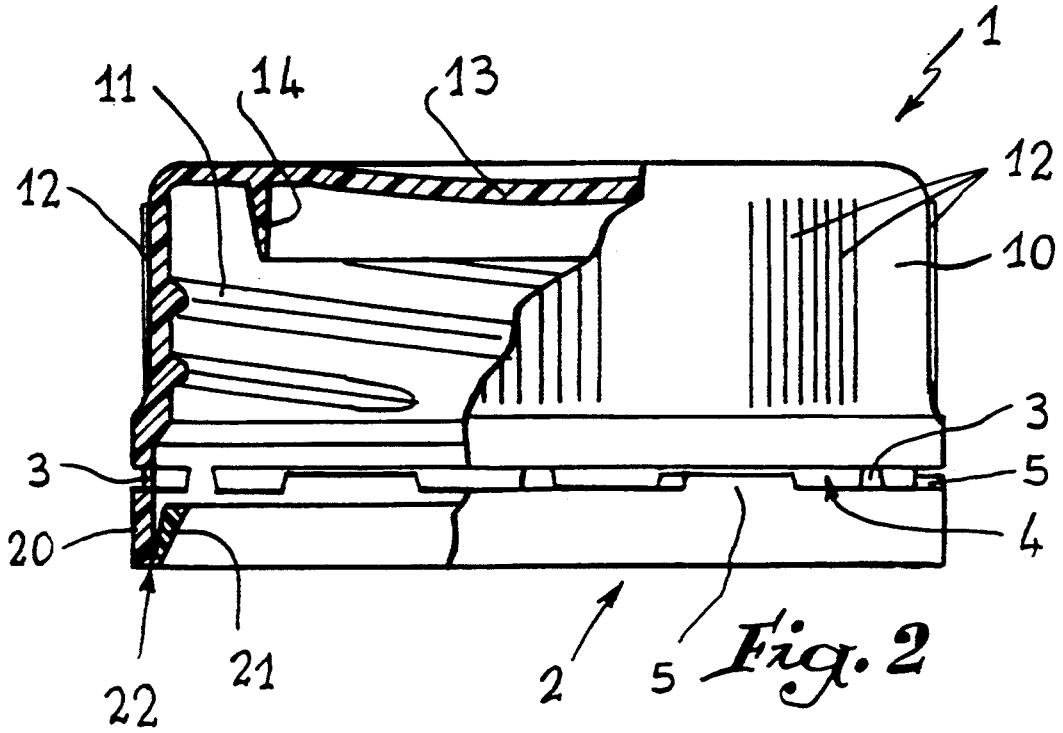
FIG. 2 is a view similar to that of FIG. 1, but showing the device according to the invention after the second ring of its tamper-proof element has been turned up.
Figure 3:
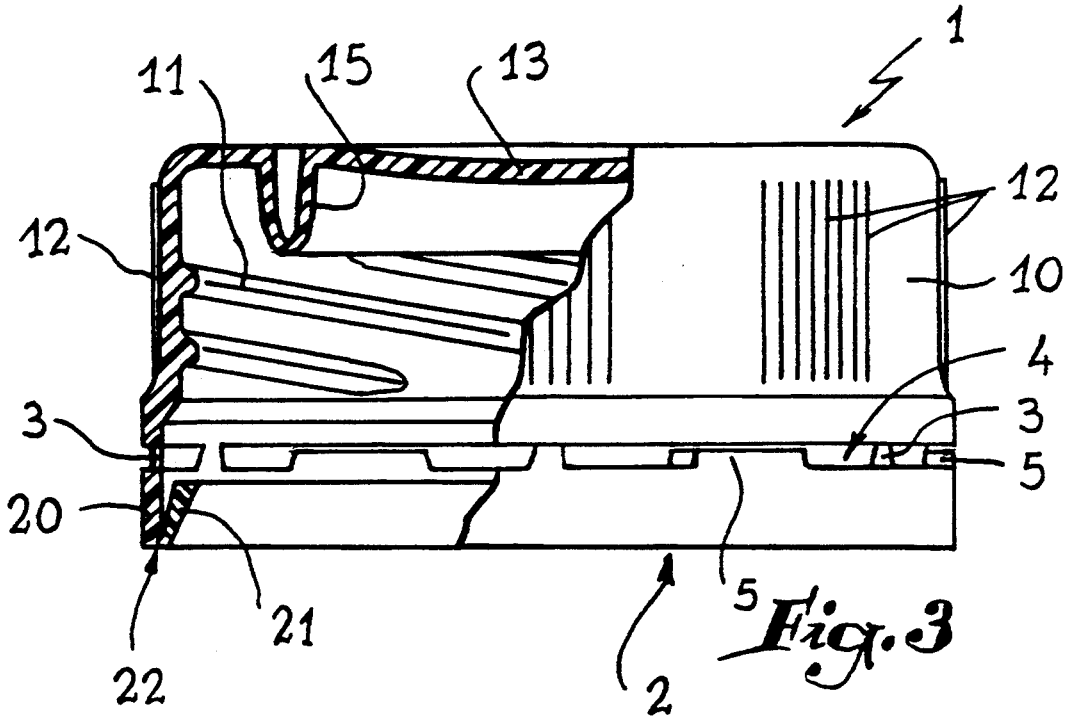
FIG. 3 is a view similar to that of FIG. 2, but showing a device according to the invention whose cap includes a double-lip seal.

Before the closure device is positioned on the neck of a container, the ring 21 is bent towards the bottom 13 of the cap 1 so that it comes into the position illustrated in FIG. 2, i.e. it is turned up thereinside so as to be adjacent the inner face of ring 20.

When the device illustrated in FIGS. 1 and 2 is positioned on the neck of a bottle, the free edge of the second ring 21 of the guarantee strip 2 abuts against the bottom of the conventional ring of the neck in order to retain, in tamper-proof manner, the cap screwed on the neck.

In accordance with a variant embodiment, the seal 14 is made in the form of a double-lip seal 15.

Figure 5:
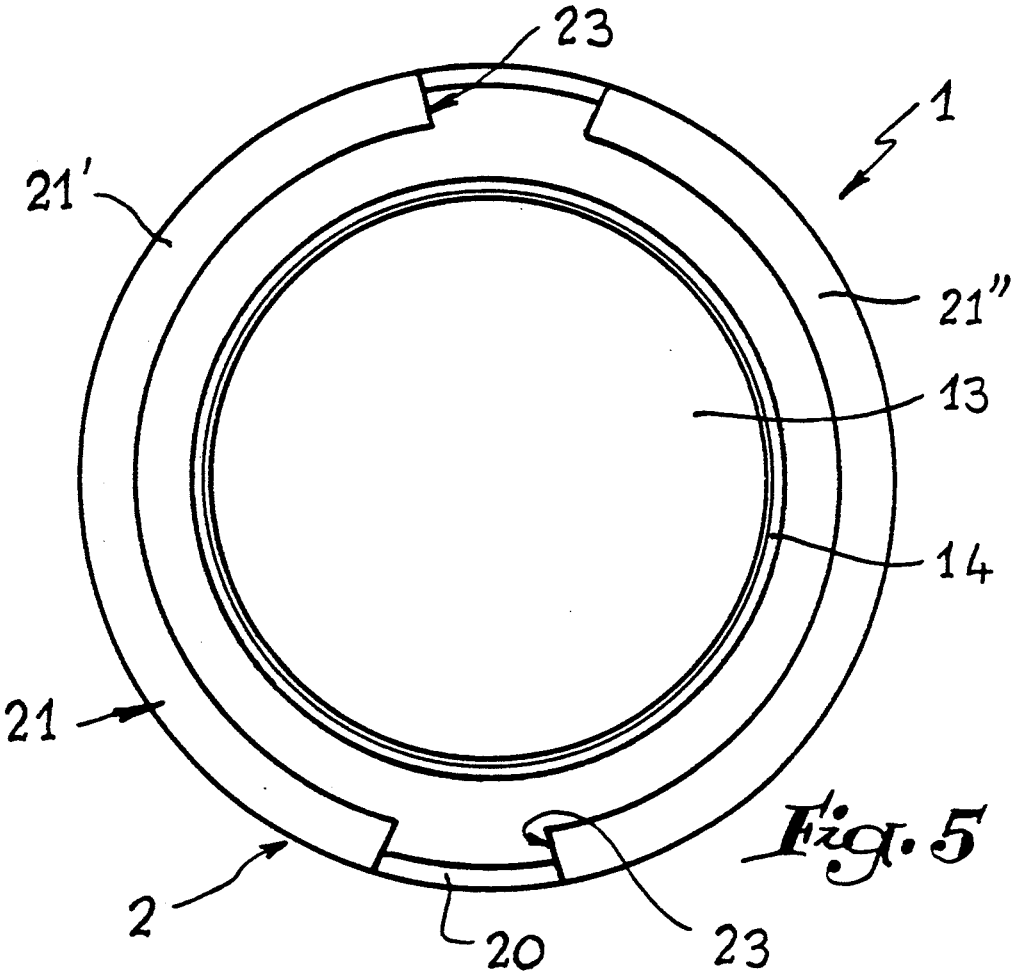
FIG. 5 is a bottom plane view of the cap of FIG. 4.
Figure 4:
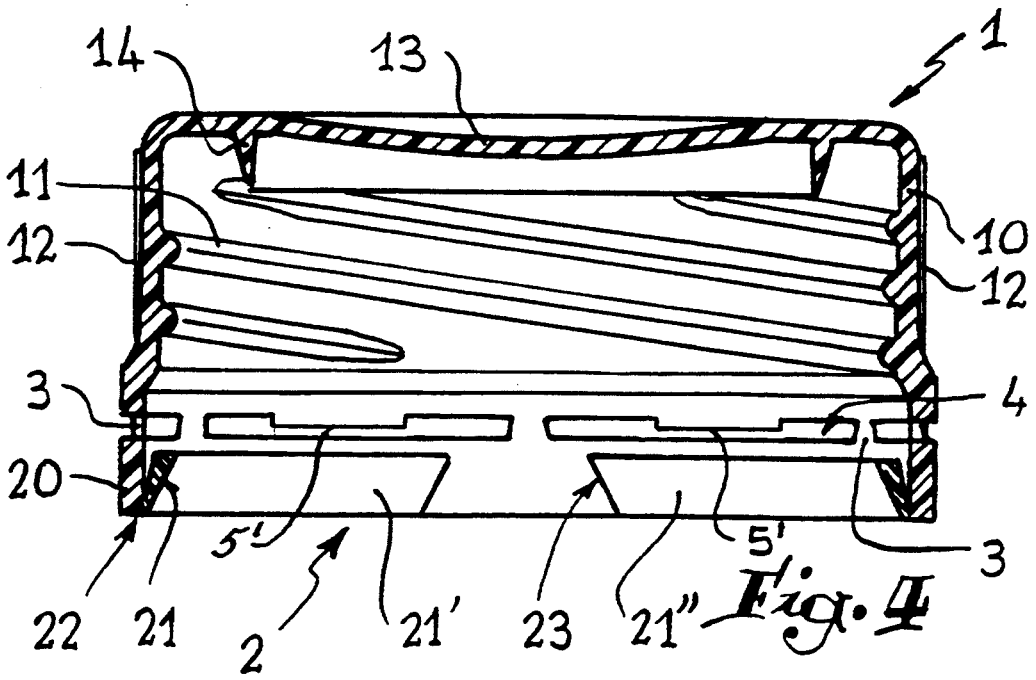
FIG. 4 is a view similar to that of FIG. 2, but showing a device according to the invention of which the second ring of the guarantee strip is divided into sections.

With a view to facilitating turn-up of the second ring 21, the latter comprises two gaps 23 which divide it into two elements 21', 21'' as illustrated in FIGS. 4 and 5.

Figure 6:
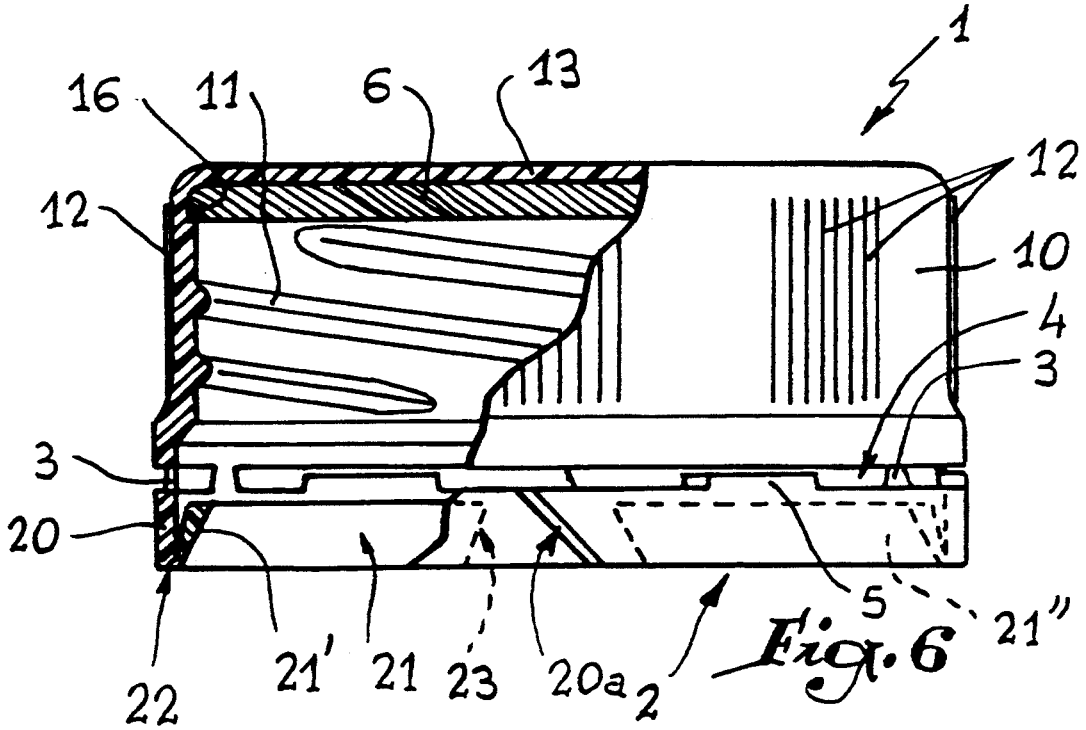
FIG. 6 is a view similar to that of FIG. 4, but showing a slight variant embodiment.

In a final embodiment illustrated in FIG. 6, the bottom 13 of the cap 1 is flat, while its skirt 10 comprises, at the bottom, a groove 16 capable of receiving a flat seal 6.

In addition, the first ring 20 of the guarantee strip 2 is provided, opposite the gaps 23 in the second ring 21, with at least one oblique groove **20*a* which is of reduced thickness and whose origin lies near one of the bridges 3. In this way, unscrewing of the cap 1 provokes, on the one hand, rupture of the bridges 3, and, on the other hand, a tearing of the first ring 20 of the guarantee strip 2** which is thus separated from the neck of the container. The container may therefore be recycled directly without any intervention to separate it from the guarantee strip, as is usually the case.

It must, moreover, be understood that the foregoing description has been given only by way of example and that it in no way limits the domain of the invention which would not be exceeded by replacing the details of execution by any other equivalents.

What is claimed is:

1. In a screw-type closure device made of a plastic material of the type having a cap with a skirt the bottom of which is associated with an annular guarantee strip which includes a bead for cooperatively engaging the neck of a container to prevent removal of the cap, the closure device comprising:

the guarantee strip having a first ring connected to the bottom of the skirt by frangible bridge elements which are separated by spaces and a second ring connected to the first ring by a peripheral zone of reduced thickness whereby the second ring may be turned up inside the first ring, the second ring being divided into at least two independent segments separated by gaps, and the first ring of the guarantee strip having at least one oblique groove of reduced thickness formed therein opposite one of said gaps in the second ring, the bridge elements being ruptured upon the removal of the cap from the container thereby separating the guarantee strip from the skirt of the cap and, the first ring of the guarantee strip being severed along said oblique groove thereby releasing the guarantee strip from the container upon removal of the cap from the container.

2. The closure device of claim 1 wherein stops extend in the spaces separating the bottom of the skirt and the first ring of the guarantee strip.

3. The closure device of claim 2 wherein the stops are integral with the bottom of the skirt of the cap.

4. The closure device of claim 2 wherein the stops are integral with the first ring of the guarantee strip.

5. The closure device of claim 2 wherein the cap includes an upper inner face having a tubular seal extending therefrom.

6. The closure device of claim 2 wherein the cap includes an upper inner face having a double-lip seal extending therefrom.

7. The closure device of claim 2 wherein the cap includes an upper inner face, the skirt having a groove therein adjacent said upper inner face and a flat seal mounted within said groove.

8. The closure device of claim 1 wherein the cap includes an upper inner face having a tubular seal extending therefrom.

9. The closure device of claim 1 wherein the cap includes an upper inner face having a double-lip seal extending therefrom.

10. The closure device of claim 1 wherein the cap includes an upper inner face, the skirt having a groove therein adjacent said upper inner face and a flat seal mounted within said groove.

* * * * *